US008584769B2

(12) United States Patent
Friedrich et al.

(10) Patent No.: US 8,584,769 B2
(45) Date of Patent: Nov. 19, 2013

(54) VIBRATION REDUCTION HANDLE ASSEMBLY FOR A HAMMER DRILL

(75) Inventors: Andreas Friedrich, Limburg (DE); Ulrich Berghauser, Diehardt (DE); Frantisek Harcar, Lipany (SK)

(73) Assignee: Black & Decker Inc., Newark, DE (US)

( * ) Notice: Subject to any disclaimer, the term of this patent is extended or adjusted under 35 U.S.C. 154(b) by 314 days.

(21) Appl. No.: 12/876,403

(22) Filed: Sep. 7, 2010

(65) Prior Publication Data

US 2011/0127056 A1 Jun. 2, 2011

(51) Int. Cl.
*B25D 17/24* (2006.01)

(52) U.S. Cl.
USPC ..... 173/162.2; 173/162.1; 173/210; 173/211; 173/170; 16/431

(58) Field of Classification Search
USPC ..... 173/162.2, 162.1, 210, 211, 170; 16/431
See application file for complete search history.

(56) References Cited

U.S. PATENT DOCUMENTS

| | | | | |
|---|---|---|---|---|
| 1,358,486 | A * | 11/1920 | Wilhelm | 173/162.2 |
| 3,322,211 | A * | 5/1967 | Alabuzhev et al. | 173/162.2 |
| 4,711,308 | A * | 12/1987 | Blaas et al. | 173/162.2 |
| 5,522,466 | A * | 6/1996 | Harada et al. | 173/162.2 |
| 6,148,930 | A * | 11/2000 | Berger et al. | 173/162.2 |
| 7,322,428 | B2 * | 1/2008 | Bacila | 173/162.2 |
| 2003/0132016 | A1 * | 7/2003 | Meixner et al. | 173/162.2 |
| 2004/0040729 | A1 * | 3/2004 | Meixner | 173/162.2 |
| 2005/0247454 | A1 | 11/2005 | Domann et al. | |
| 2008/0022817 | A1 | 1/2008 | Fischer et al. | |

FOREIGN PATENT DOCUMENTS

| | | |
|---|---|---|
| DE | 1672058 | 2/1954 |
| DE | 29700003 | 2/1997 |
| EP | 1707321 | 10/2006 |
| GB | 2413299 | 10/2005 |
| WO | 2008034668 | 3/2008 |

* cited by examiner

*Primary Examiner* — Michelle Lopez
(74) *Attorney, Agent, or Firm* — Kofi Schulterbrandt; Scott B. Markow; Adan Ayala

(57) ABSTRACT

A motorized hammer has a body and a tool holder which is mounted on the front of the body and is capable of imparting impacts via the tool in the holder. A rear handle is, moveably mounted to the rear of the body via at least one movement control mechanism which is capable of moving towards or away from the body. A biasing mechanism biases the rear handle away from the body and each movement control mechanism includes a first mount. A rod having a longitudinal axis is rigidly connected at one of it ends to the first mount. A second mount slidingly engages with the rod at two distinct points only along its length to allow the rod to slide relative to the second mount in a direction parallel to the longitudinal axis. The second mount prevents the rod from moving in a direction perpendicular to the longitudinal axis.

14 Claims, 6 Drawing Sheets

VIBRATION REDUCTION HANDLE ASSEMBLY FOR A HAMMER DRILL

FIELD OF THE INVENTION

The present invention relates to a hammer drill, and in particular, a vibration dampening mechanism for a handle of a hammer drill.

BACKGROUND OF THE INVENTION

A typical hammer drill comprises a body in which is mounted an electric motor and a hammer mechanism. A tool holder is mounted on the front of the body which holds a cutting tool, such as a drill bit or a chisel. The hammer mechanism typically comprises a slideable ram reciprocatingly driven by a piston, the piston being reciprocatingly driven by the motor via a set of gears and a crank mechanism or wobble bearing. The ram repeatedly strikes the end of the cutting tool via a beat piece. When the only action on the tool bit is the repetitive striking of its end by the beat piece, the hammer drill is operating in a hammer only mode.

Certain types of hammer drill also comprise a rotary drive mechanism which enables the tool holder to rotatingly drive the cutting tool held within the tool holder. This can be in addition to the repetitive striking of the end of the cutting tool by the beat piece (in which case, the hammer drill is operating in a hammer and drill mode) or as an alternative to the repetitive striking of the end of the cutting tool by the beat piece (in which case, the hammer drill is operating in a drill only mode).

EP1157788 discloses a typical hammer drill.

BRIEF SUMMARY OF THE INVENTION

Hammer drills are supported by the operator using handles. In one type of hammer drill, there is one rear handle attached to the rear of the body of the hammer drill, at the opposite end of the body to where the tool holder is mounted. The operator pushes the cutting tool into a work piece by pushing the rear handle towards the body, which in turn pushes the body and the cutting tool towards the work piece.

A problem associated with hammer drills is the vibration generated by the operation of the hammer drill, and in particular, the vibration generated by the operation of the hammer mechanism. This vibration is transferred to the hands of the operator holding the handles of the hammer drill, particularly through the rear handle. This can result in the injury of the hands of the operator. As such, it is desirable to minimise the effect of vibration experienced by the hands of the operator. This is achieved by reducing the amount by which the handle vibrates.

There are two ways of reducing the amount by which the rear handle vibrates. The first method is to reduce the amount of vibration produced by the whole hammer drill. The second method is to reduce the amount of vibration transferred from the body of the hammer drill to the rear handle. The present invention relates to the second method.

EP1529603 discloses a dampening mechanism for a rear handle by which the amount of vibration transferred from the body to the handle is reduced.

The rear handle is slideably mounted on the body using connectors 230. Springs 220 bias the handle 202 rearwardly away from the housing 212, and which act to dampen vibration to reduce the amount transferred from the housing 212 to the handle 202. A movement co-ordination mechanism is provided, which comprises an axial 216, which interacts with the connectors 230 to ensure that the movement of the two ends of the handle are in unison.

The problem with the design of dampening mechanism disclosed in EP1529603 is that the movement co-ordination mechanism is located within the housing. As such, it takes up valuable space.

EP2018938 seeks to overcome this problem by placing the movement co-ordination mechanism in the handle.

However, in both EP1529603 and EP2018928, the designs of handle require a movement co-ordination mechanism which incurs extra cost and complexity.

In EP152603, there are provided two bars (230*a*, 230*b*) connected to the handle which slide within guides (232*a*, 232*b*) mounted on the housing. In EP2018928, there are provided two bars (24; 104) connected to the housing which slide within guides (26) mounted on the handle. In both designs, the amount of contact in the lengthwise direction between the bars and the guides remain constant at all times. The amount of contact is dependent on the length of the guide. This is regardless of the position of the handle versus the housing. As such, the amount of support for the bars against a bending force applied to the bars remains constant regardless of the amount of force applied to the handle to move it towards the housing. Only the position of the guides on the bars alters as the handle moves relative to the housing.

Furthermore, the guides are shown as making contact along the whole length of the part of the bars located inside of the guides. However, in reality, the inner surfaces of the guide and the external surfaces formed on the bar are not perfectly flat due to manufacturing tolerances and wear. Therefore, to ensure that the bars slide smoothly within the guides, the dimensions of the cross section of the bars are slightly less than that of the cross section of the passageways formed through the guides. This however, allows the bars to move by a small amount in a direction perpendicular to its longitudinal axis within the guide. This allows the handle to move side ways thus increasing the amount of vibration transferred to the handle.

Accordingly, there is provided a hammer drill comprising:

a body in which is mounted a motor and a hammer mechanism which is driven by the motor when the motor is activated;

a tool holder mounted on the front of the body and which is capable of holding a cutting tool, the hammer mechanism, when driven by the motor, capable of imparting impacts to the cutting tool, when held by the tool holder;

a rear handle, moveably mounted on to the rear of the body via at least one movement control mechanism and which is capable of moving towards or away from the body;

a biasing mechanism which biases the rear handle away from the body;

wherein each movement control mechanism comprises:

a first mount;

a rod, having a longitudinal axis, rigidly connected at one of it ends to the first mount;

a second mount which slidingly engages with the rod at two distinct points only along its length to allow the rod to slide relative to the second mount in a direction parallel to the longitudinal axis whilst preventing the rod from moving relative to second mount in a direction perpendicular to longitudinal axis;

wherein one mount is attached to the body and the other mount is attached to the rear handle.

As there are only two distinct points of contact, there is no contact between the rod and the second mount any where else. It will be appreciated that at each of the two points where they slidingly connect, a part of the second mount can slide along a part of the rod or that part of the rod can slide along a part of the second mount.

The use of two distinct points of contact only ensure that a good contact can be made with the rod at theses points in order to provide a strong sideways support for the rod against a bending force acting on the rod, thus preventing any sideways movement of the rod.

Preferably, the second mount comprises a first engaging portion which slidingly engages with the side of the rod and the rod comprises a second engaging portion which slidingly engages with a sliding surface formed on the second mount; wherein the position on the rod, where the first engaging portion engages the rod relative to position of the second engaging portion on the rod, is arranged so that the first engaging portion moves away from the second engaging portion as the handle moves towards the body.

The use of two distinct points of contact provides a sturdy sideways support for the rod. The handle moves towards the body, against the biasing force of the biasing mechanism, due to increased pressure applied to the handle by an operator. As the pressure applied to the handle increases, so do the bending forces applied to the rod. By arranging for the points of contact to move apart as the handle moves towards the body, the amount of sideways support for rod against a bending force increases as the bending forces increase due to the increase in pressure being applied to the handle by operator.

Preferably, the first engaging portion slidingly engages the rod between the second engaging portion and the first mount.

The second engaging portion can be formed on the free end of the rod remote from the first mount.

The second mount can comprise a tubular guide which surrounds the rod and slidingly engages with the side of the rod; and wherein the tubular guide has an inner surface which tapers outwardly along its length, the guide slidingly engaging the rod at its narrowest point.

Whilst one of the embodiments below shows only one point of contact where the second mount engages with the rod with a tubular guide having such a construction, it will be appreciated by the reader that both points of contact could be formed using guides with such a construction.

Alternatively, the second mount can comprise a tubular guide which surrounds the rod and slidingly engages with the side of the rod; and wherein the tubular guide has an inner surface which is convex along its length, the guide slidingly engaging the rod at its narrowest point.

Whilst one of the embodiments below shows only one point of contact where the second mount engages with the rod with a tubular guide having such a construction, it will be appreciated by the reader that both points of contact could be formed using guides with such a construction.

The cross sectional shape of the part of rod along which the tubular guide slides is ideally uniform along its length and the cross sectional shape and dimensions of the tubular guide at its narrowest point preferably correspond to that of the shape and dimensions of the cross section of the tube.

Ideally, the cross sectional shape of the tubular guide at its narrowest point is identical to that of the shape of the cross section of the tube and is preferably circular. By having the cross sections correspond or identical in shape and dimensions, this provides contact around the majority or whole of the circumference of the rod, and therefore prevents any sideways movement of the rod.

The second mount can comprise a housing in which is formed a tubular passage; and wherein the rod can extend into the tubular passage and comprise an engaging portion located within the tubular passage which slidingly engages with a sliding surface formed on the wall of tubular passage, the rod and engaging portion being capable of sliding lengthwise within the passage.

Whilst one of the embodiments below shows only one point of contact where the second mount engages with the rod with a guide having such a construction, it will be appreciated by the reader that both points of contact could be formed using guides with such a construction.

Preferably, the cross sectional shape of the tubular passage corresponds to that of the shape and dimensions of the cross section of the engaging portion.

Ideally, the cross sectional shapes are identical. Preferably, the cross sectional shape is coffin shaped. By having the cross sectional shapes correspond or identical to each other, it provides one method of ensuring that there is contact around the majority or all of the periphery of the engaging portion and the inner wall of the tubular passage and therefore, prevents sideways movement of the rod inside of the tubular passage.

In the tubular passage, there can be provided platforms on inner wall of the tubular passage which extend lengthwise within the passage and along which the engaging portion slides.

The platforms provide a defined contact area between the engaging portion and the wall of the tubular passage along which the engaging portion slides. Thus no gaps are left between the engaging portion and the platforms, thus preventing any sideways movement of the engaging portion in the tubular passage. This also guarantees a smooth sliding action between the engaging portion and the platforms and prevents the engaging portion from sticking within the tubular passage. The platforms also reduce the size of the area of contact between the engaging portion and the wall of tubular passage, thus reducing the frictional contact. The platforms also produce air passageways between the platforms, the inner wall of the tubular passage and the engaging portion. This allows air to travel around the head as it slides backward and forwards inside the tubular passage.

A resilient cushion can be attached to the housing inside of the tubular passage, at the end of the tubular passage remote from the first mount, and which makes contact with the engaging portion when the handle is located at its closest position to the body.

The biasing mechanism can comprise a helical spring which surrounds the rod and is sandwiched between the first and second mounts.

The handle comprises a centre grip section and two end connection sections, one connected to each end of the centre grip section; and wherein there can be two movement control mechanisms, a first movement control mechanism connected between the rear of the body and a first end connection section and a second movement control mechanism connected between the rear of the body and a second end connection section.

At least one of the movement control mechanisms can comprise an adjustment mechanism which allows the position where the rod connects to the first mount be adjusted.

This allows the hammer drill to be assembled with out any bending stress being applied to the rods of the movement control mechanisms whilst accommodating variations in the manufacturing tolerances of the component parts of the hammer drill, and in particular, variations in the length of the centre grip section of the handle.

The movement control mechanism can comprise a bolt which rigidly attaches the rod to the first mount, and the adjustment mechanism can comprise an hole having an elongate cross sectional shape formed in the first mount; wherein the bolt passes through the hole and rigidly attaches the rod to the first mount at a point along the length of the elongate hole.

Ideally, the hole has an oval cross sectional shape and has its longer axis extending in a direction towards the other movement control mechanism. If the first mount is formed on the handle, the longer axis of the hole could extend in a direction substantially parallel to the longitudinal axis of the centre grip section of the handle.

BRIEF DESCRIPTION OF THE DRAWINGS

Two embodiments of the invention will now be described with reference to the accompanying drawings of which.

DETAILED DESCRIPTION OF THE INVENTION

A first embodiment of the present invention will now be described with reference to FIGS. 1 to 6.

Figure 1:
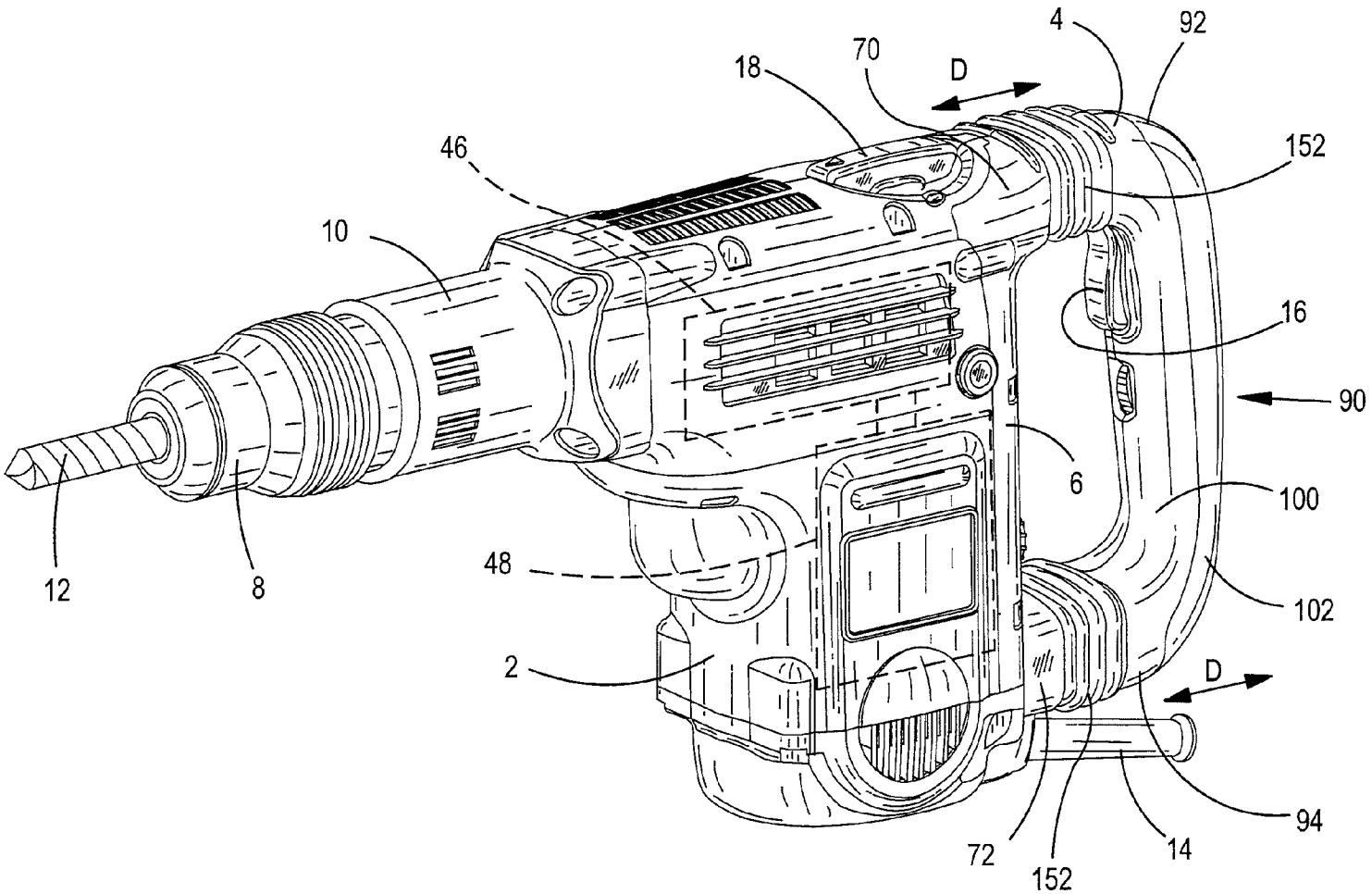
FIG. 1 shows a sketch of a side view of a hammer drill.

Referring to FIG. 1, the hammer drill comprises a body 2 having a rear handle 4 moveably mounted to the rear of the body 2. The rear handle 4 comprises a centre grip section 90 and two end connection sections 92; 94, one end connection section being attached to one end of the centre grip section, the other end connection section being connected to the other end of the centre grip section. The handle 4 is connected to the rear of the body 2 by the two end connection sections 92, 94. The rear handle is constructed from a plastic clam shell 100 and a rear end cap 102 which is attached to the clam shell 100 using screws (not shown). The rear of the body is formed by three plastic clam shells 6, 70, 72 which attach to each other and to the remainder of the body 2 using screws (not shown).

A tool holder 8 is mounted onto the front 10 of the body 2. The tool holder can hold a cutting tool 12, such as a drill bit. A motor (shown generally by dashed lines 48) is mounted within the body 2 which is powered by a mains electricity supply via a cable 14. A trigger switch 16 is mounted on the rear handle 4. Depression of the trigger switch 16 activates the motor in the normal manner. The motor drives a hammer mechanism (shown generally by dashed lines 46), which comprises a ram (not shown) reciprocatingly driven by the motor within a cylinder (not shown) which in turn strikes, via a beat piece (not shown), the end of the cutting tool 12. In addition, or alternatively, the motor can rotationally drive the tool holder 8 via a series of gears (not shown). A mode change mechanism (not shown) can switch the hammer drill between three modes of operation, namely hammer only mode, drill only mode or hammer and drill mode. A rotatable knob 18 is mounted on the top of the body 2. Rotation of the knob 18 changes the mode of operation of the hammer drill in well known manner.

The rear handle 4 can move in the direction of Arrow D in FIG. 1. The movement of handle 4 is controlled using two movement control mechanisms, as described below, so that it moves linearly towards or away from the body 2 of the hammer drill, but is prevented from rotation relative to the body 2 of the hammer drill. Two helical springs 104 bias the rear handle 4 away from the body 2.

The two movement control mechanisms will now be described with reference to FIGS. 2 to 6. Each movement control mechanism is identical to the other movement control mechanism. As such, a single description of a movement control mechanism will be provided but is equally applicable to either of the two movement control mechanisms.

Each movement control mechanism comprises a metal tube 106 of circular cross section and with a smooth outer surface, one end of which located with a correspondingly shaped recess 108 form in the clam shell 100 of the rear handle 4. A plastic plug 110 comprises an elongate body 112 of circular cross section with a head 114, having a coffin shaped cross section (see FIG. 5), attached to one end. The outer diameter of the elongate body 112 is the same as the inner diameter of the tube 106. The head 114 has dimensions which are greater than the inner diameter of the tube 106. The elongate body 112 is slid inside the free end of the tube 106 remote from the handle 4 until the head 114 is located adjacent the free end as shown in the Figures.

A hole 109 is formed through the base of the recess 108 which extends through to a cut out 118 formed in the rear of the clam shell 100 of the handle 4. A threaded shaft 116 of a bolt passes through a metal washer 120 located in the cut out 118, through the hole 109, through the length of the tube 106 and screws into a threaded bore 122 formed in the elongate body 112 of the plug 110. The head 124 of the bolt locates against the washer 120 in the cut out 118. The bolt rigidly secures the plug 110 to the tube 106 and the tube to the clam shell 100 of the rear handle 4.

Two of the clam shells 70, 72 which form the rear of the body 2 each have a recess formed in two sections, a front section 126 and a rear section 128 separated by an annular ridge 130. Each recess forms a part of one of the movement control mechanism.

Figure 2:
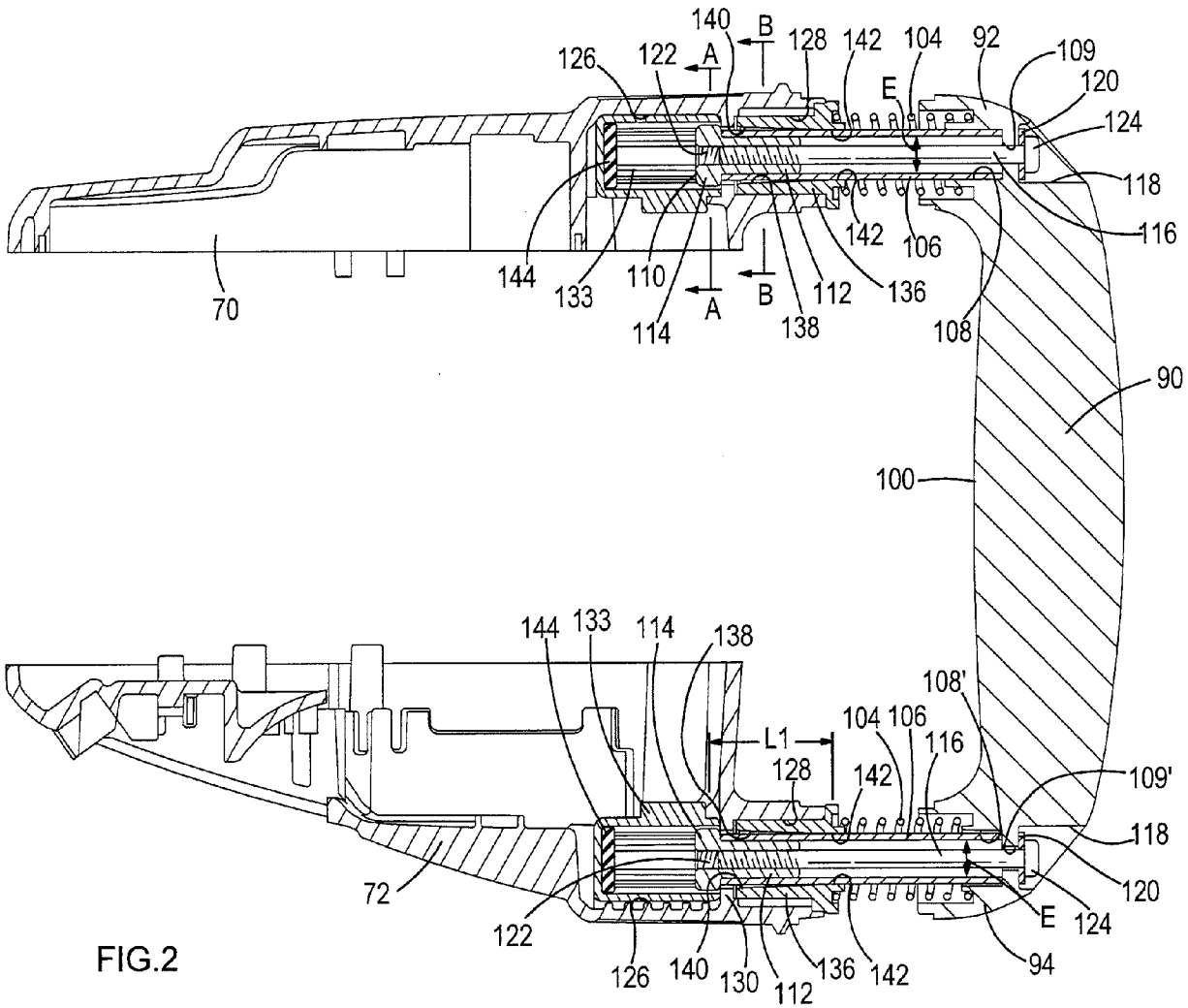
FIG. 2 shows a vertical cross section of the rear handle assembly when the handle is biased away from the body by the maximum amount according to the first embodiment of the present invention.
Figure 3:
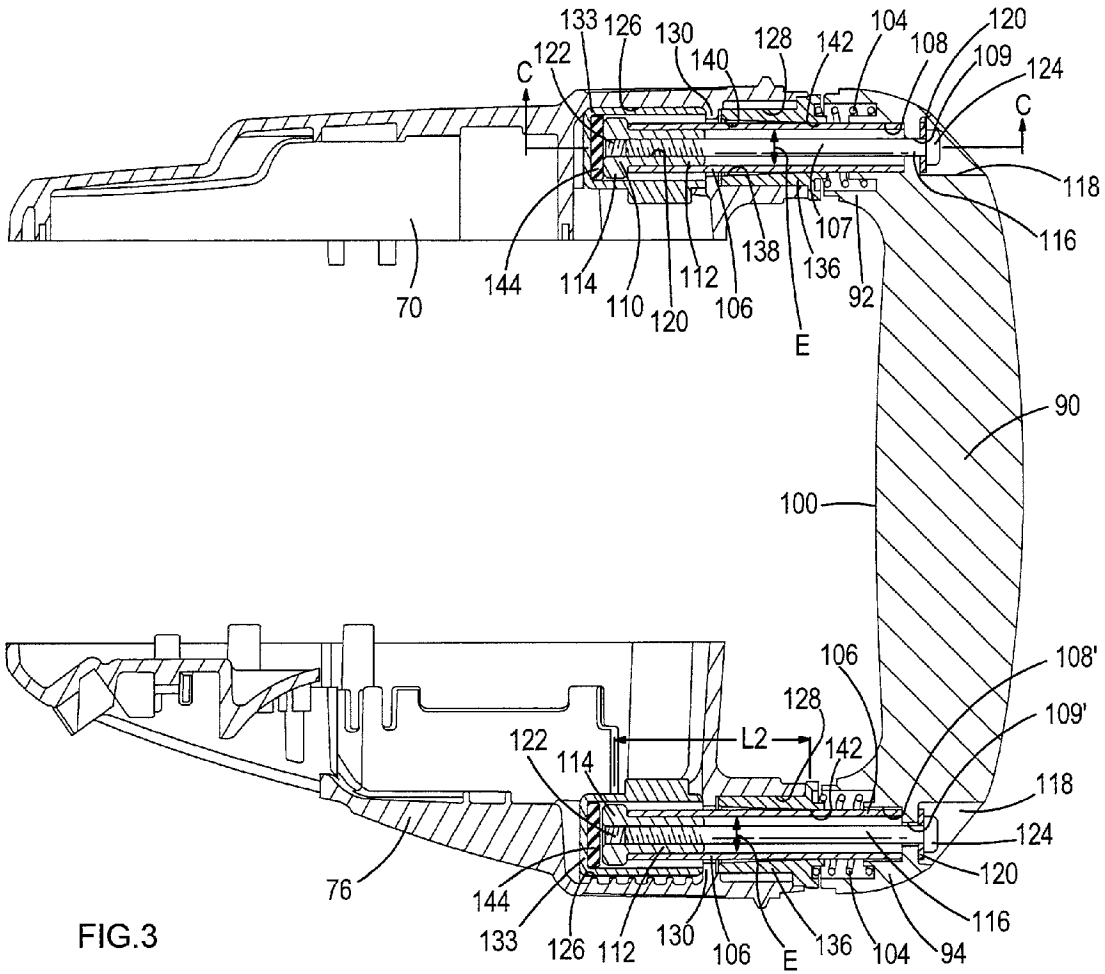
FIG. 3 shows a vertical cross section of the rear handle assembly shown in FIG. 2 when the handle is moved to its closest position to the body against the biasing force of the springs.
Figure 4:
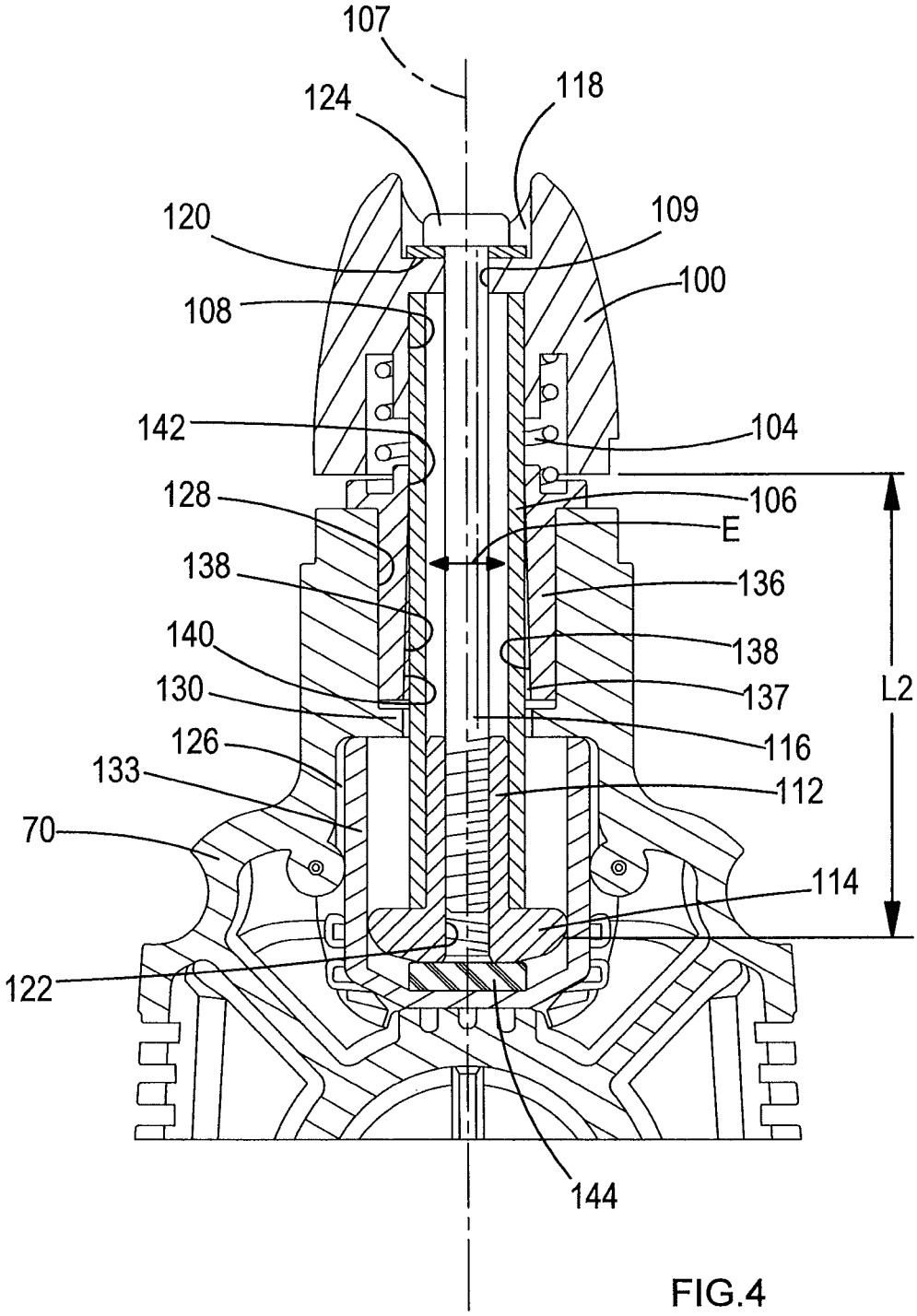
FIG. 4 is a cross section view in the direction of Arrows C in FIG. 3.
Figure 6:
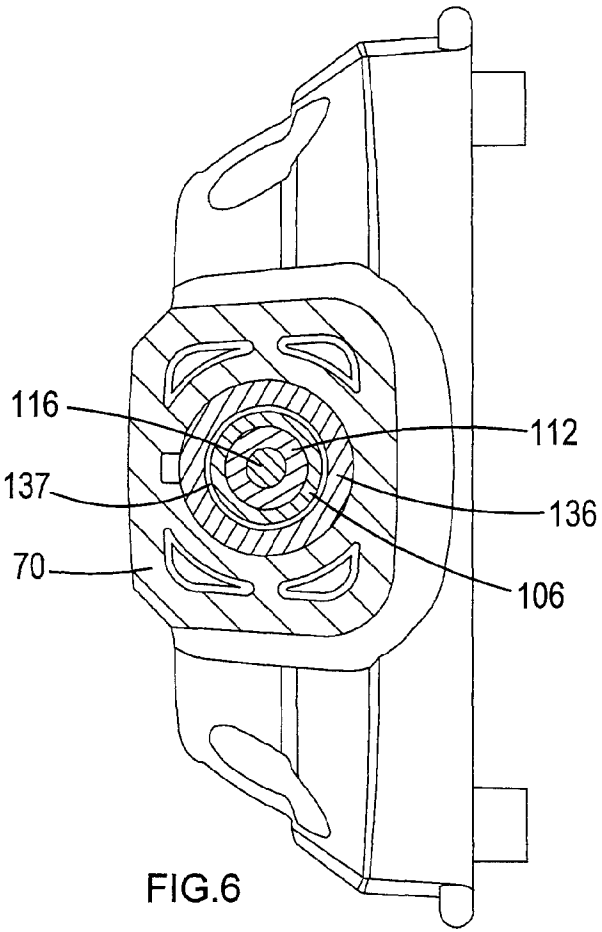
FIG. 6 is a cross section view in the direction of Arrows B in FIG. 2.
Figure 5:
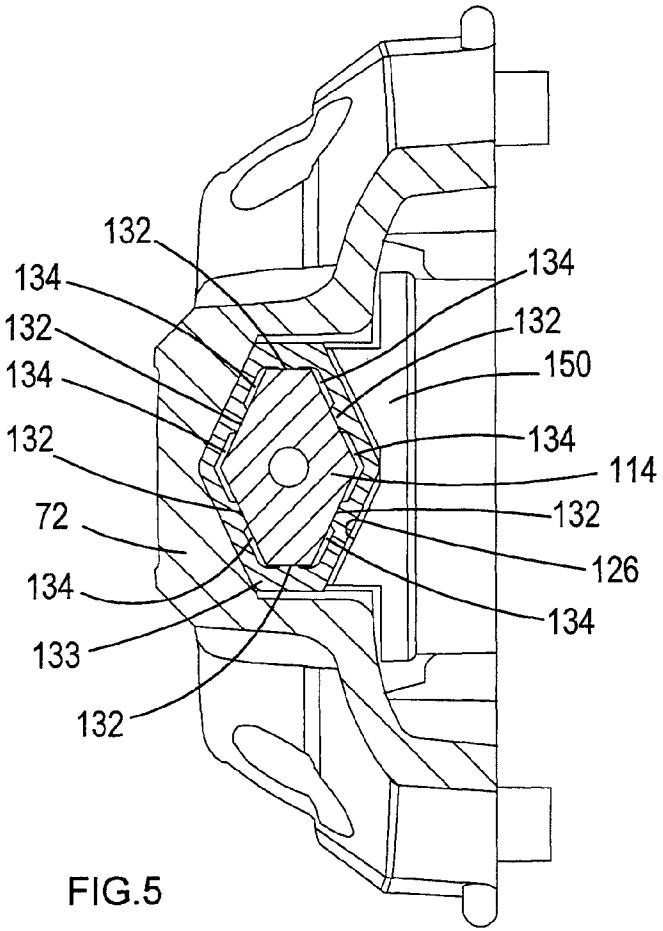
FIG. 5 is a cross section view in the direction of Arrows A in FIG. 2.

Located in the front section 126 of each recess is a first rigid plastic tubular insert 133 which has a tubular passage within it which is coffin shaped in cross section along its length as shown in FIG. 5. The tubular insert 133 is held in place in the clam shell 70, 72 by a plastic cover 150 which is attached to the clam shell 70, 72 using screws (not shown). The dimensions of the cross sectional shape of the tubular passage corresponds to that of the head 114. The head 114 locates inside of the insert 133 and is capable of sliding from the rear end (FIG. 2) of the tubular passage, along the length of the passage, to the front end (FIG. 3). Along the inside walls of the tubular passage are platforms 132 which extend lengthwise within the tubular passage and which slidingly engage with the sides of the head 114 of the plastic plug 110 to support the head 114. These provide a defined contact area between the insert 133 and head 114 along which the head 114 slides. Thus no gaps are left between the head 114 and the platforms 132, thus preventing any sideways movement (in the direction of Arrow E) of the head 114 in the first tubular insert 133. This also guarantees a smooth sliding action between the head and the insert 133. The platforms also reduce the size of the area of contact between the head 114 and the insert 133, thus reducing the frictional contact. The platforms 132 also produce air passageways 134 between the platforms 132, the inner walls of the insert 133 and the head 114. This allows air to travel around the head 114 as it slides backward and forwards inside the tubular passage.

Located in the rear section 128 of each recess is a second rigid plastic tubular insert 136. The second insert 136 has an inner surface 138 which is circular in cross section and which tapers, in a lengthwise direction, from a narrow cross section 142 at the rear end to a larger cross section 140 at the front end. The part of the insert 136 with the smallest cross section area 142 has the same dimensions as that of the outer diameter of the tube 106 and slidingly engages with the smooth outer surface of tube 106. The part of the insert 136 with the largest cross section area 140 has the dimensions which are greater than that of the outer diameter of the tube 106 and therefore a gap 137 is formed between the outer surface of tube 106 and the inner surface 138 of the insert (see FIG. 6). This ensures that the only part of the insert 136 which engages the tube is the rear part 142. As such, a flush contact is made between the insert 136 and the side of the tube 106 at a single point along the length of the tube. Therefore, there is no side ways movement of the tube 106 inside the second insert 136 in a direction (Arrow E) perpendicular to the longitudinal axis 107 of the tube 106.

The only connection between the tube 106 and the body 2 is at two points only along the length of the tune 106. The connection points are formed via the inserts 133, 136. The first connection point is via the side of the head 114 engaging with the platforms 132 on the inner walls of the first tubular insert 133. The second connection point is via the side of the tube 106 engaging the part 142 of the second tubular insert 136 having the smallest cross section. In between these two points, there is no contact between the tube 106 and the inserts 133, 136 or the clam shells 70, 72. Such a construction ensures that the movement of the handle 4 is linear, in a direction parallel to the longitudinal axis 107 of the tube 106. As there are two movement control mechanisms, the handle 4 is prevented from rotation about the longitudinal axis 107 of either of the tubes 106 of the two movement control mechanisms. As such, the movement of the handle 4 is totally linear and without any kind of rotation relative to the body 2.

Sandwiched between the clam shell 100 of the handle 4 and the clam shell 70, 72 of the body 2 and surrounding the tube 106 is a helical spring 104. The helical spring biases the handle away from the body 2. During the use of the hammer, the springs of the two movement control mechanisms absorb vibration from the body 2, reducing the amount transferred from the body 2 to the handle 4. Bellows 152 surround the spring 104 and the tube 106 and connect between the clam shell 100 of the handle 4 and the clam shell 70, 72 of the rear of the body 2 to prevent the ingress of dust during use of the hammer.

Located inside the first tubular insert 133 at the forward end of the tubular passage is a resilient cushion 144 made of rubber material. When the handle 4 is pushed towards the body 2 to its inner most position (see FIG. 3), the head 114 engages with the cushion 144, preventing the head 114 from moving further forward. The cushion 144 also damps any vibration which would otherwise be transmitted from the insert to the head 144.

It should be noted that there is a slight difference in designs for the recess 108 and the hole 109 for the two movement control mechanisms. Referring to FIG. 2, the recess 108 and the and the hole 109 of the top movement control mechanism as viewed, are circular in cross section. This ensures that the position of the tube 106 and/or the shaft 116 of the bolt, in a direction perpendicular to their longitudinal axes 107, relative to the clam shell 100 of the handle 4 is fixed. However, the recess 108' and the and the hole 109' of the lower movement control mechanism as viewed in FIG. 2, are oval in cross section, with the longer axis of the oval being vertical (a small gap is visible in FIG. 2). This allows the position of the tube 106 and/or the shaft 116 of the bolt, in a vertical direction, to be varied relative to the shell 100 of the handle 4. This is to accommodate manufacturing tolerances of the clam shell 100 which result in small variations in the length of the shell. The oval recess 108' and hole 109' allow the tube 106 and the bolt of the lower movement control mechanism to locate in positions within the recess 108' and hole 109' where there are no bending stress (in the direction of Arrow E) on the tube 106 and bolt. This in turn prevents there being any bending stresses (in the direction of Arrow E) on the tube 106 and bolt of the top movement control mechanism. Once these positions in the recess 108' and hole 109' for the tube 106 and bolt have been obtained, they are fixed relative to the shell 100 by screwing the bolt tightly into the threaded bore 122 of the plug 110. This allows for a precise contact between the heads 114 of the plugs 110 and the platforms 132 of the first tubular inserts 133, and the narrowest point 142 of the second tubular insert 136 and the tube 106 of both of the movement control mechanisms, thus allowing a smooth sliding action.

The operation of the movement control mechanisms will now be described.

When the hammer drill is not being used, the handle is biased away from the body 2 under the influence of the two helical springs 104 to the position shown in FIG. 2. In this position, the heads 114 of the plugs 110 are located at the rear most position of the first tubular inserts 133. Each tube 106 is supported at two points, namely, the point where the part 142 of the second tubular insert 136 having the smallest cross section engages the side of the tube 106 and the point where the head 114 of the plug 110 engages the inner walls of the rear most part of the tubular passage of the first tubular insert 133. The distance between these two points is L1.

When an operator commences to use the hammer drill, the operator supports it with the rear handle and applies a pressure on the handle 4, pushing it towards the body 2 against the biasing force off the springs 104. As the handle 4 moves towards the body 2, each tube 106 slides axially into the body 2. As it does so, the head 114 of each plug 110 slides forward inside of the first tubular insert 133 towards the cushion 144. As it does so, each tube 106 slides through the second tubular insert 136, the part 142 of the second tubular insert 136 having the smallest cross section sliding along the side of the tube 106 as it does so. It should be noted the two movement control mechanism operate in unison.

The platforms 132 on the inner wall of the first tubular insert, which provide a defined contact area between the insert 133 and head 114 along which the head 114 slides, enables relative sliding action between the head and the insert 133 to be smooth and prevents the head from jamming inside of the first tubular insert 133.

As the outer surface of the tube is smooth, the sliding movement of the part 142 of the second tubular insert 136 having the smallest cross section along the side of the tube 106 is smooth.

Any vibration generated by the operation of the hammer is damped by the helical springs 104. The smooth sliding action between the head 114 and the insert 133, due to the platforms 132, and the tube 106 and the second tubular insert 136, maximizes the damping efficiency of the springs 104.

No other connection is made between the tube 106 and the inserts 133, 136 other than via the side of the head 114 engaging with the platforms 132 on the inner walls of the first tubular insert 133 and via the side of the tube 106 engaging the part 142 of the second tubular insert 136 having the smallest cross section, as the tube slides into the body 2.

As the tube slides into the body, the distance between the two points, namely, the point where the part 142 of the second tubular insert 136 having the smallest cross section engages the side of the tube 106 and the point where the head 114 of the plug 110 engages the inner wall of the rear most part of the tubular passage of the first tubular insert 133, increases.

When the operator has applied the maximum pressure to the handle 4, the head 114 of the plug 110 is located at the fore most position of the first tubular insert 133 adjacent the cushion 144 as shown in FIG. 3. The distance between these two support points is L2. The head 114 engages with the cushion is prevented from moving any further inside of the first tubular insert 133.

As can be seen in FIGS. 1 and 2, the distance L2 is greater than L1. This has the advantage that, as the pressure applied by the operator on the handle during use increases, the distance between the support points along the length of the tube 106 increases, providing an increasing amount of support to the tube 106 against bending forces (in the direction of Arrow E). As such, it provides a wider support structure to the tube 106. When the maximum pressure is applied to the handle, the two support points are the maximum distance part, providing the greatest support to the tube 106 against bending.

Figure 7:
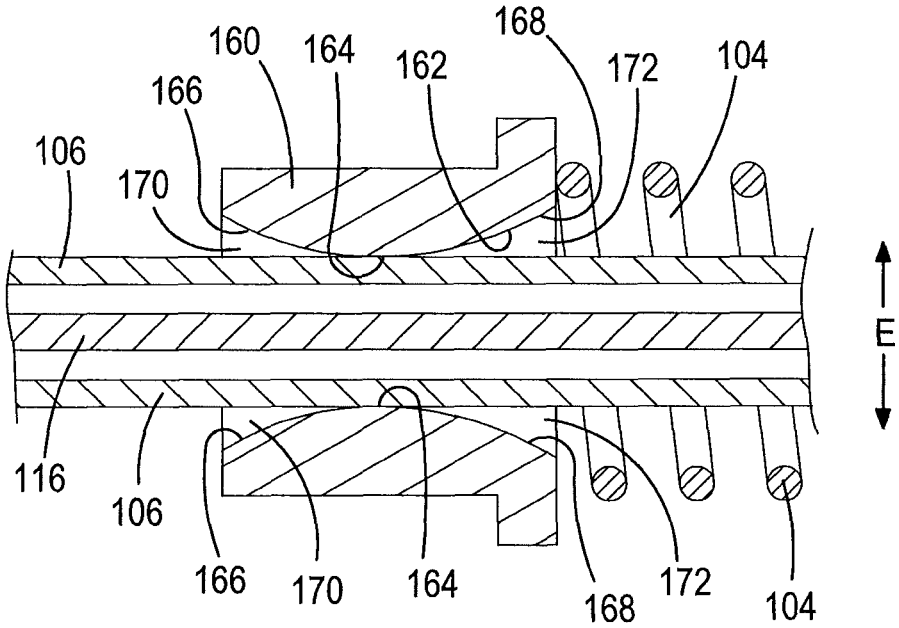
FIG. 7 shows a cross sectional view of an insert according to the second embodiment of the present invention.

A second embodiment will now be described with reference to FIG. 7. Where the same features are present in the second embodiment which are present in the first embodiment, the same reference numbers have been used.

The second embodiment is exactly the same as the first embodiment except for the design of the second tubular insert 133 in each of the movement control mechanisms, which has been altered.

Each second rigid plastic tubular insert 160 of both movement control mechanism in the second embodiment has an inner surface 162 which is circular in cross section and which, in a lengthwise direction, is convex, from a narrow cross section 164 at the centre, to two larger cross sections 166, 168 at the front and rear ends. The part 164 of the insert 160 with the smallest cross section area has the same dimensions as that of the outer diameter of the tube 106 and slidingly engages with the smooth outer surface of tube 106. The parts 166, 168 of the insert 160 with the largest cross section areas have dimensions which are greater than that of the outer diameter of the tube 106 and therefore gaps 170, 172 are formed between the outer surface of tube 106 and the inner surfaces 166, 168 of the insert 160 (see FIG. 7). This ensures that the only part of the insert 160 which engages the tube 106 is the centre part 164. As such, a flush contact is made between the insert 160 and the side of the tube 106 at a single point along the length of the tube. Therefore, there is no side ways movement of the tube 106 inside the second insert 160 in a direction (Arrow E) perpendicular to the longitudinal axis 107 of the tube 106.

The movement control mechanism of the second embodiment operates in exactly the same manner as the first embodiment.

The invention claimed is:

1. A hammer drill comprising:

a body in which is mounted a motor and a hammer mechanism which is driven by the motor when the motor is activated;

a tool holder mounted on the front of the body and which is capable of holding a cutting tool, the hammer mechanism, when driven by the motor, capable of delivering impacts to the cutting tool, when held by the tool holder;

a rear handle, moveably mounted on to the rear of the body via at least one movement control mechanism and which is capable of moving towards or away from the body;

a biasing mechanism which biases the rear handle away from the body;

wherein each movement control mechanism comprises:

a first mount;

a rod, having a longitudinal axis, rigidly connected at one of it ends to the first mount;

a second mount which slidingly engages with the rod at two distinct points only along its length to allow the rod to slide relative to the second mount in a direction parallel to the longitudinal axis whilst preventing the rod from moving relative to second mount in a direction perpendicular to longitudinal axis;

wherein one mount is attached to the body and the other mount is attached to the rear handle; and wherein the second mount comprises a tubular guide which surrounds the rod and slidingly engages with the side of the rod; and wherein the tubular guide has an inner surface which tapers outwardly along its length, the guide slidingly engaging the rod at its narrowest point.

2. A hammer drill as claimed in claim 1, wherein the second mount comprises a first engaging portion which slidingly engages with a side of the rod and the rod comprises a second engaging portion which slidingly engages with a sliding surface formed on the second mount;

wherein a position on the rod where the first engaging portion engages the rod relative to a position of the second engaging portion on the rod, is arranged so that the first engaging portion moves away from the second engaging portion as the handle moves towards the body.

3. A hammer drill as claimed in claim 2, wherein the first engaging portion slidingly engages the rod between the second engaging portion and the first mount.

4. A hammer drill as claimed in claim 2, wherein the second engaging portion is formed on a free end of the rod remote from the first mount.

5. A hammer drill as claimed in claim 1, wherein the second mount comprises a tubular guide which surrounds the rod and slidingly engages with the side of the rod; and wherein the tubular guide has an inner surface which is convex along its length, the guide slidingly engaging the rod at its narrowest point.

6. A hammer drill as claimed in claim 1, wherein the cross sectional shape of the part of the rod along which the tubular guide slides is uniform along its length and the cross sectional shape and dimensions of the tubular guide at its narrowest point correspond to that of the shape and dimensions of the cross section of the rod.

7. A hammer drill as claimed in claim 1, wherein the second mount comprises a housing in which is formed a tubular passage; and wherein the rod extends into the tubular passage and comprises an engaging portion located within the tubular passage which slidingly engages with a sliding surface formed on a wall of the tubular passage, the rod and engaging portion being capable of sliding lengthwise within the passage.

8. A hammer drill as claimed in claim 7, wherein the cross sectional shape of the tubular passage corresponds to that of the shape and dimensions of the cross section of the engaging portion.

9. A hammer drill as claimed in claim 7, wherein there are provided platforms on inner wall of the tubular passage which extend lengthwise within the passage and along which the engaging portion slides.

10. A hammer drill as claimed in claim 1, wherein the biasing mechanism comprises a helical spring which surrounds the rod and is sandwiched between the first and second mounts.

11. A hammer drill as claimed in claim 1, wherein the handle comprises a centre grip section and two end connection sections one connected to each end of the centre grip section; and wherein there are two movement control mechanisms, a first movement control mechanism connected between the rear of the body and a first end connection section and a second movement control mechanism connected between the rear of the body and a second end connection section.

12. A hammer drill as claimed in claim 11, wherein at least one of the movement control mechanisms comprises an adjustment mechanism which allows the position where the rod connects to the first mount be adjusted.

13. A hammer drill comprising:

a body in which is mounted a motor and a hammer mechanism which is driven by the motor when the motor is activated;

a tool holder mounted on the front of the body and which is capable of holding a cutting tool, the hammer mechanism, when driven by the motor, capable of delivering impacts to the cutting tool, when held by the tool holder;

a rear handle, moveably mounted on to the rear of the body via at least one movement control mechanism and which is capable of moving towards or away from the body;

a biasing mechanism which biases the rear handle away from the body;

wherein each movement control mechanism comprises:

a first mount;

a rod, having a longitudinal axis, rigidly connected at one of it ends to the first mount;

a second mount which slidingly engages with the rod at two distinct points only along its length to allow the rod to slide relative to the second mount in a direction parallel to the longitudinal axis whilst preventing the rod from moving relative to second mount in a direction perpendicular to longitudinal axis;

wherein one mount is attached to the body and the other mount is attached to the rear handle; and wherein the second mount comprises a housing in which is formed a tubular passage; and wherein the rod extends into the tubular passage and comprises an engaging portion located within the tubular passage which slidingly engages with a sliding surface formed on a wall of the tubular passage, the rod and engaging portion being capable of sliding lengthwise within the passage; and wherein there is provided a resilient cushion attached to the housing inside of the tubular passage, at the end of the tubular passage remote from the first mount, and which makes contact with the engaging portion when the handle is located at its closest position to the body.

14. A hammer drill comprising:

a body in which is mounted a motor and a hammer mechanism which is driven by the motor when the motor is activated;

a tool holder mounted on the front of the body and which is capable of holding a cutting tool, the hammer mechanism, when driven by the motor, capable of delivering impacts to the cutting tool, when held by the tool holder;

a rear handle, moveably mounted on to the rear of the body via at least one movement control mechanism and which is capable of moving towards or away from the body;

a biasing mechanism which biases the rear handle away from the body;

wherein each movement control mechanism comprises:

a first mount;

a rod, having a longitudinal axis, rigidly connected at one of it ends to the first mount;

a second mount which slidingly engages with the rod at two distinct points only along its length to allow the rod to slide relative to the second mount in a direction parallel to the longitudinal axis whilst preventing the rod from moving relative to second mount in a direction perpendicular to longitudinal axis;

wherein one mount is attached to the body and the other mount is attached to the rear handle; and wherein the handle comprises a centre grip section and two end connection sections one connected to each end of the centre grip section; and wherein there are two movement control mechanisms, a first movement control mechanism connected between the rear of the body and a first end connection section and a second movement control mechanism connected between the rear of the body and a second end connection section, and wherein at least one of the movement control mechanisms comprises an adjustment mechanism which allows the position where the rod connects to the first mount be adjusted, and wherein the movement control mechanism comprises a bolt which rigidly attaches the rod to the first mount, and the adjustment mechanism comprises an hole having an elongate cross sectional shape formed in the first mount; and wherein the bolt passes through the hole and rigidly attaches the rod to the first mount at a point along the length of the elongate hole.

* * * * *